US007178342B1

(12) United States Patent
Knapp

(10) Patent No.: US 7,178,342 B1
(45) Date of Patent: Feb. 20, 2007

(54) INSTANT SNOWMAN

(76) Inventor: Cory Knapp, 3168 Acacia La., Alpine, CA (US) 91901

( * ) Notice: Subject to any disclaimer, the term of this patent is extended or adjusted under 35 U.S.C. 154(b) by 220 days.

(21) Appl. No.: 10/921,426

(22) Filed: Aug. 19, 2004

(51) Int. Cl.
*F25C 1/00* (2006.01)

(52) U.S. Cl. ..... 62/1; 62/140

(58) Field of Classification Search ..... 62/1, 62/140, 340
See application file for complete search history.

(56) References Cited

U.S. PATENT DOCUMENTS 2,959,940 A * 11/1960 McDonald ..... 62/458
3,328,974 A * 7/1967 Matsushita ..... 62/246
4,351,157 A * 9/1982 Zeigler ..... 62/1
5,018,360 A * 5/1991 Jones ..... 62/66
5,241,830 A * 9/1993 Morioka et al. ..... 62/91
5,632,926 A 5/1997 Dyer, Jr.
5,851,415 A 12/1998 Thomas
6,176,464 B1 1/2001 Harvey
6,381,968 B1 * 5/2002 O'Donoghue et al. ..... 62/74

* cited by examiner

*Primary Examiner*—William E. Tapolcai

(57) ABSTRACT

An artificial snowman system for to allow a user to enjoy a snowman in climates that may not support snow. The artificial snowman system includes a form assembly being for resting on a support surface. A conduit is coupled to the form assembly whereby the conduit is coiled around an exterior of the form assembly. A refrigeration assembly is coupled to the conduit whereby the refrigeration assembly is in fluid communication with the conduit. The refrigeration assembly is for pumping refrigerant through the conduit whereby the conduit is cooled by the refrigerant to cool air around the conduit and freeze the moisture in the air to the conduit to provide the form assembly with the appearance of being made of snow.

7 Claims, 3 Drawing Sheets

INSTANT SNOWMAN

I. BACKGROUND OF THE INVENTION

The present invention relates to snow molds and more particularly pertains to a new artificial snowman system for to allow a user to enjoy a snowman in climates that may not support snow.

II. DESCRIPTION OF THE PRIOR ART

The use of snow molds is known in the prior art. More specifically, snow molds heretofore devised and utilized are known to consist basically of familiar, expected and obvious structural configurations, notwithstanding the myriad of designs encompassed by the crowded prior art which have been developed for the fulfillment of countless objectives and requirements.

Illustrative examples of such devices include: U.S. Pat. No. 5,851,415; U.S. Pat. No. 5,632,926; and U.S. Pat. No. 6,176,464.

In these respects, the artificial snowman system according to the present invention substantially departs from the conventional concepts and designs of the prior art, and in so doing provides an apparatus primarily developed for the purpose of to allow a user to enjoy a snowman in climates that may not support snow.

III. SUMMARY OF THE INVENTION

In view of the foregoing disadvantages inherent in the known types of snow molds now present in the prior art, the present invention provides a new artificial snowman system construction wherein the same can be utilized for to allow a user to enjoy a snowman in climates that may not support snow.

To attain this, the present invention generally comprises a form assembly being for resting on a support surface. A conduit is coupled to the form assembly whereby the conduit is coiled around an exterior of the form assembly. A refrigeration assembly is coupled to the conduit whereby the refrigeration assembly is in fluid communication with the conduit. The refrigeration assembly is for pumping refrigerant through the conduit whereby the conduit is cooled by the refrigerant to cool air around the conduit and freeze the moisture in the air to the conduit to provide the form assembly with the appearance of being made of snow.

There has thus been outlined, rather broadly, the more important features of an artificial snowman system in order that the detailed description thereof that follows may be better understood, and in order that the present contribution to the art may be better appreciated. There are additional features of the artificial snowman system that will be described hereinafter and which will form the subject matter of the claims appended hereto.

In this respect, before explaining at least one embodiment of the artificial snowman system in detail, it is to be understood that the artificial snowman system is not limited in its application to the details of construction and to the arrangements of the components set forth in the following description or illustrated in the drawings. The artificial snowman system is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present artificial snowman system. It is important, therefore, that the claims be regarded as including such equivalent constructions insofar as they do not depart from the spirit and scope of the present invention.

One significant advantage of the present invention is to allow a user to create a snowman without the need of snow to form the snowman.

It is another object of the present invention to provide an artificial snowman system which has all of the advantages of the prior art and none of the disadvantages.

It is another object of the present invention to provide an artificial snowman system which may be easily and efficiently manufactured and marketed.

It is another object of the present invention to provide an artificial snowman system which is of durable and reliable construction.

It is yet another object of the present invention to provide an artificial snowman system which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
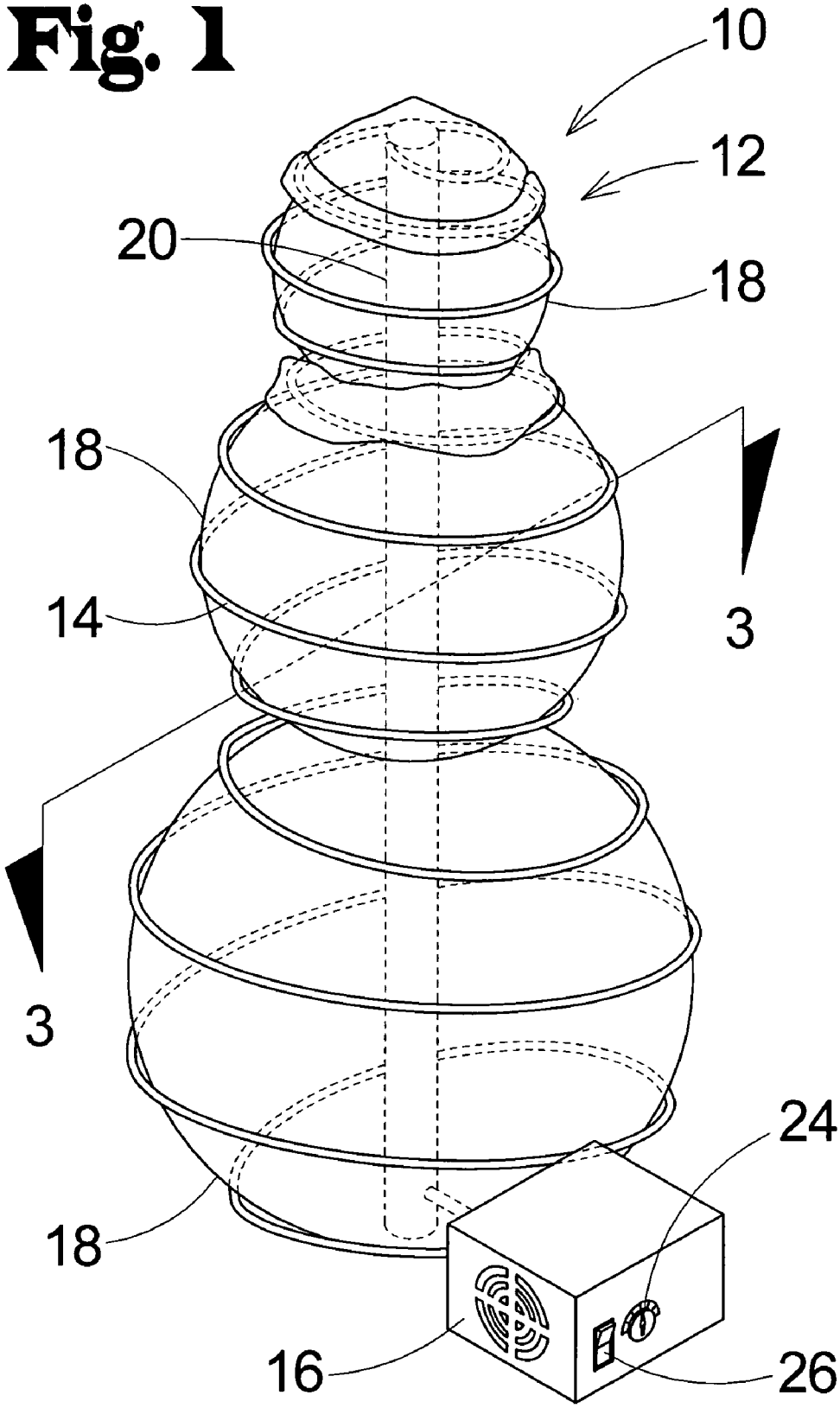
FIG. 1 is a rear perspective view of a new artificial snowman system according to the present invention.
Figure 2:
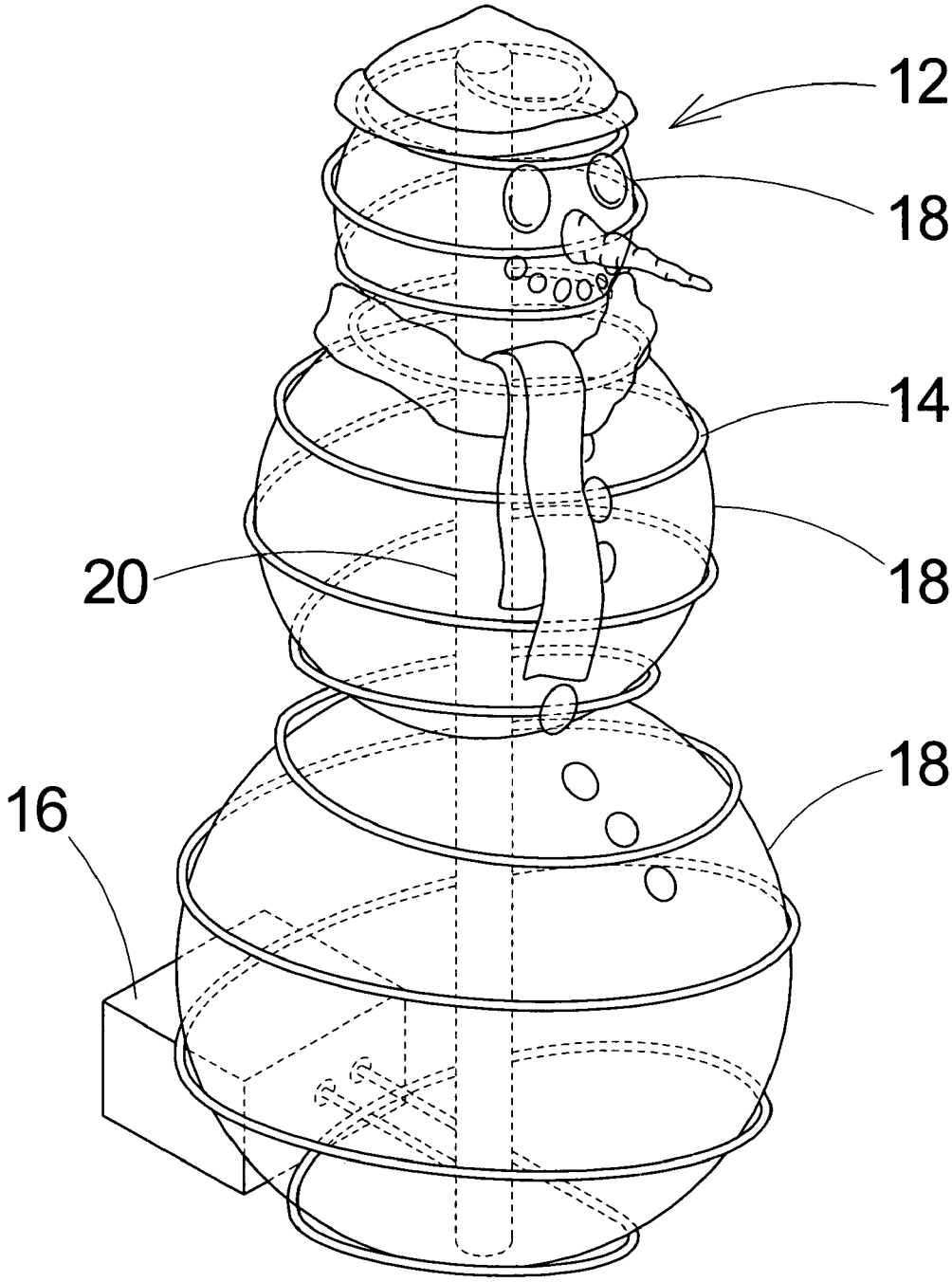
FIG. 2 is a front perspective view of the present invention.
Figure 3:
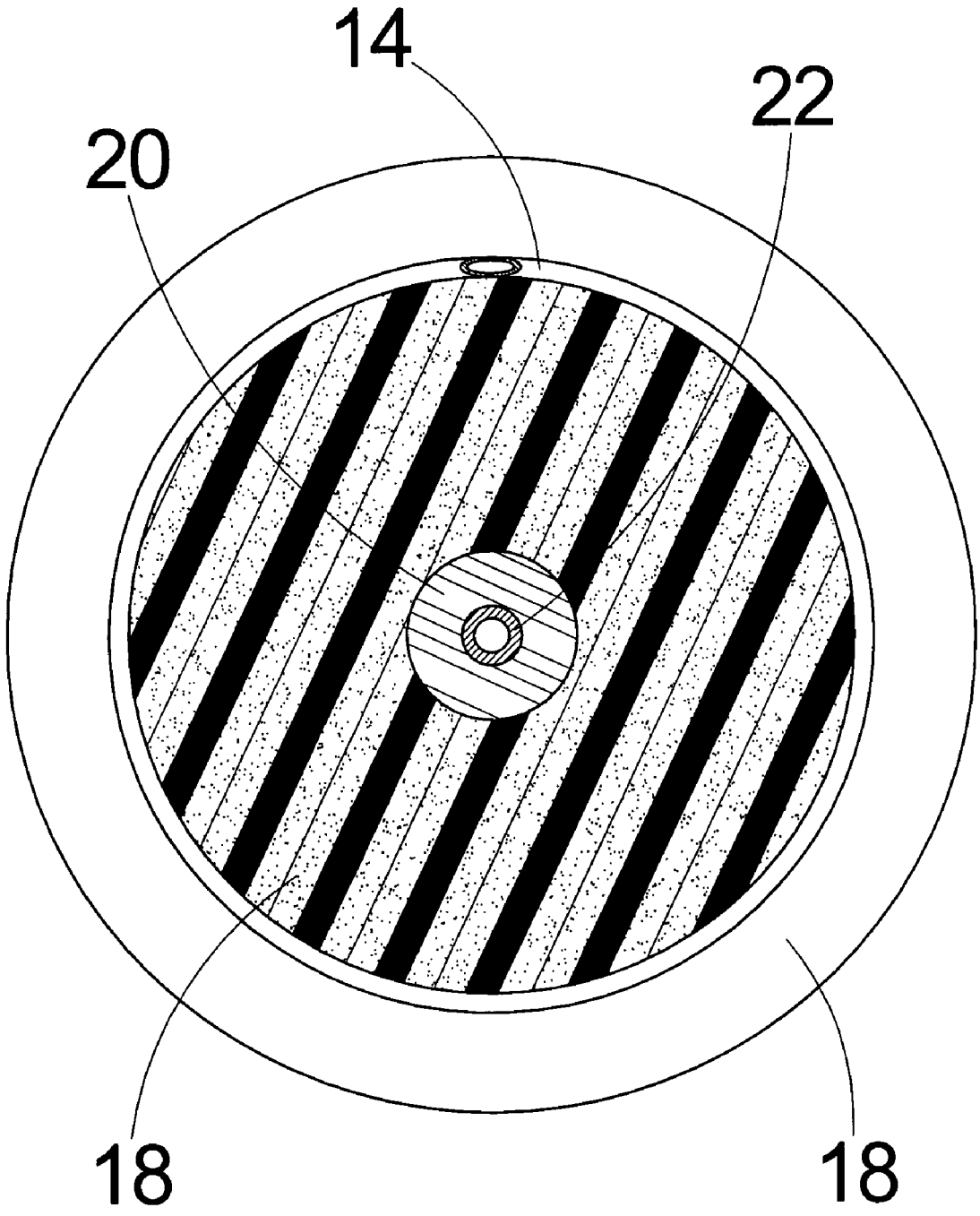
FIG. 3 is a cross-sectional view of the present invention taken along line 3—3 of FIG. 2.

With reference now to the drawings, and in particular to FIGS. 1 through 3 thereof, a new artificial snowman system embodying the principles and concepts of the present invention and generally designated by the reference numeral 10 will be described.

As best illustrated in FIGS. 1 through 3, the artificial snowman system 10 generally comprises a form assembly 12 being for resting on a support surface.

A conduit 14 is coupled to the form assembly 12 whereby the conduit 14 is coiled around an exterior of the form assembly 12.

A refrigeration assembly 16 is coupled to the conduit 14 whereby the refrigeration assembly 16 is in fluid communication with the conduit 14. The refrigeration assembly 16 is for pumping refrigerant through the conduit 14 whereby the conduit 14 is cooled by the refrigerant to cool air around the conduit 14 and freeze the moisture in the air to the conduit 14 to provide the form assembly 12 with the appearance of being made of snow.

The form assembly 12 comprises a plurality of spherical members 18. The spherical members 18 are vertically stacked whereby the spherical members 18 are arranged for resembling a snowman. The plurality of spherical members 18 comprises three spherical members 18 to form a traditional snowman shape when the spherical members 18 are stacked vertically.

Each of the spherical members 18 has a unique diameter from the other of the spherical members 18, The one of the spherical members 18 having the largest diameter is positioned on the support surface whereby each of the spherical members 18 has a diameter smaller than the diameter of the spherical member positioned below it to form the shape of the snowman.

A support member 20 extends through the spherical members 18 of the form assembly 12 whereby the support member 20 is for providing support for the form assembly 12.

A return pipe 22 is coupled to the conduit 14 and the refrigeration assembly 16 whereby the return pipe 22 is in fluid communication with the conduit 14 and the refrigeration assembly 16. The return pipe 22 extends through the support member 20. The return pipe 22 is for permitting refrigerant pumped through the conduit 14 to return to the refrigeration assembly 16.

A switch member 24 is operationally coupled to the refrigeration assembly 16. The switch member 24 is for controlling the flow of power from a power source to the refrigeration assembly 16 when the switch member 24 is actuated by a user.

A light emitting member 26 is operationally coupled between the switch member 24 and the refrigeration assembly 16. The light emitting member 26 is for emitting light to indicate power is being supplied to the refrigeration assembly 16 when the switch member 24 is actuated by the user.

In use, the user places the form assembly 12 with the conduit 14 coiled around the form assembly 12 outside. The refrigeration assembly 16 coupled to the conduit 14 is switched on to allow the refrigeration assembly 16 to pump the refrigerant through the conduit 14. As the refrigerant passes through the conduit 14 the air around the conduit 14 is cooled and the moisture in the air freezes to the conduit 14 and surrounds the form assembly 12 in ice to provide the appearance that the form assembly 12 is made of snow. The form assembly 12 can then be decorated like a regular snowman.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. An artificial snowman system comprising:

a form assembly being for resting on a support surface, a conduit being coupled to said form assembly such that said conduit is coiled around an exterior of said form assembly, a refrigeration assembly being coupled to said conduit such that said refrigeration assembly is in fluid communication with said conduit, said refrigeration assembly being for pumping refrigerant through said conduit such that said conduit is cooled by the refrigerant to cool air around said conduit and freeze the moisture in the air to the conduit to provide said form assembly with the appearance of being made of snow, a support member extending through said form assembly such that said support assembly is for providing support for said form assembly, and a return pipe being coupled to said conduit and said refrigeration assembly such that said return pipe is in fluid communication with said conduit and said refrigeration assembly, said return pipe extending through said support member, said return pipe being for permitting refrigerant pumped through said conduit to return to said refrigeration assembly.

2. The artificial snowman system as set forth in claim 1, further wherein said form assembly comprises a plurality of spherical members, said spherical members being vertically stacked such that said spherical members are arranged for resembling a snowman.

3. The artificial snowman system as set forth in claim 2, further wherein each of said spherical members has a unique diameter from the other of said spherical members, the one of said spherical members having the largest diameter being positioned on the support surface such that each of said spherical members has a diameter smaller than the diameter of the spherical member positioned below it to form the shape of the snowman.

4. The artificial snowman system as set forth in claim 2, further wherein said plurality of spherical members comprises three spherical members to form a traditional snowman shape when said spherical members are stacked vertically.

5. The artificial snowman system as set forth in claim 1, further comprising a switch member operationally coupled to said refrigeration assembly, said switch member being for controlling the flow of power from a power source to said refrigeration assembly when said switch member is actuated by a user.

6. The artificial snowman system as set forth in claim 5, further comprising a light emitting member operationally coupled between said switch member and said refrigeration assembly, said light emitting member being for emitting light to indicate power is being supplied to said refrigeration assembly when said switch member is actuated by the user.

7. An artificial snowman system comprising:

a form assembly being for resting on a support surface, a conduit being coupled to said form assembly such that said conduit is coiled around an exterior of said form assembly, a refrigeration assembly being coupled to said conduit such that said refrigeration assembly is in fluid communication with said conduit, said refrigeration assembly being for pumping refrigerant through said conduit such that said conduit is cooled by the refrigerant to cool air around said conduit and freeze the moisture in the air to the conduit to provide said form assembly with the appearance of being made of snow, wherein said form assembly comprising a plurality of spherical members, said spherical members being vertically stacked such that said spherical members are arranged for resembling a snowman, wherein each of said spherical members has a unique diameter from the other of said spherical members, the one of said spherical members having the largest diameter being positioned on the support surface such that each of said spherical members has a diameter smaller than the diameter of the spherical member positioned below it to form the shape of the snowman, wherein each of said plurality of spherical members comprises three spherical members to form a traditional snowman shape when said spherical members are stacked vertically, a support member extending through said spherical members of said form assembly such that said support member is for providing support for said form assembly, a return pipe being coupled to said conduit and said refrigeration assembly such that said return pipe is in fluid communication with said conduit and said refrigeration assembly, said return pipe extending through said support member, said return pipe being for permitting refrigerant pumped through said conduit to return to said refrigeration assembly, a switch member being operationally coupled to said refrigeration assembly, said switch member being for controlling the flow of power from a power source to said refrigeration assembly when said switch member is actuated by a user, and a light emitting member being operationally coupled between said switch member and said refrigeration assembly, said light emitting member being for emitting light to indicate power is being supplied to said refrigeration assembly when said switch member is actuated by the user.

* * * * *